US009085960B2

(12) United States Patent
van Petegem et al.

(10) Patent No.: US 9,085,960 B2
(45) Date of Patent: Jul. 21, 2015

(54) GRAVEL PACK BYPASS ASSEMBLY

(75) Inventors: Ronald van Petegem, Montgomery, TX (US); John P. Broussard, Kingwood, TX (US); Christopher Hall, Cypress, TX (US); Patrick J. Zimmerman, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 392 days.

(21) Appl. No.: 13/345,500

(22) Filed: Jan. 6, 2012

(65) Prior Publication Data

US 2012/0103608 A1 May 3, 2012

Related U.S. Application Data

(63) Continuation-in-part of application No. 12/913,981, filed on Oct. 28, 2010, now Pat. No. 8,770,290.

(51) Int. Cl.

| | |
|---|---|
| ***E21B 43/04*** | (2006.01) |
| ***E21B 43/08*** | (2006.01) |
| ***E21B 17/07*** | (2006.01) |
| ***E21B 33/124*** | (2006.01) |
| ***E21B 34/10*** | (2006.01) |

(Continued)

(52) U.S. Cl.

CPC ..... *E21B 43/04* (2013.01); *E21B 17/07* (2013.01); *E21B 33/124* (2013.01); *E21B 34/102* (2013.01); *E21B 43/045* (2013.01); *E21B 43/08* (2013.01); *E21B 47/09* (2013.01); *E21B 2034/007* (2013.01)

(58) Field of Classification Search

USPC ..... 166/276, 278, 51, 157, 158, 205, 332.4, 166/227–236

See application file for complete search history.

(56) References Cited

U.S. PATENT DOCUMENTS

| | | | |
|---|---|---|---|
| 3,134,439 | A | 5/1964 | Shields |
| 4,105,069 | A | 8/1978 | Baker |

(Continued)

FOREIGN PATENT DOCUMENTS

| | | | |
|---|---|---|---|
| GB | 2387401 | A | 10/2003 |
| RU | 1810500 | A1 | 4/1993 |

(Continued)

OTHER PUBLICATIONS

Dictionary Definition of "on", accessed Dec. 23, 2014 via thefreedictionary.com.*

(Continued)

*Primary Examiner* — Blake Michener

(74) *Attorney, Agent, or Firm* — Wong, Cabello, Lutsch, Rutherford & Brucculeri, LLP

(57) ABSTRACT

A gravel pack operation disposes slurry from an inner string into the annulus around a shoe track. A valve on the shoe track can open and close flow through a port, and seats around the port allow an outlet of the tool to seal with the port. When the valve is open and the outlet sealed with the port, the slurry in the string is pumped into the borehole around the shoe track by flowing the slurry from the outlet into the borehole through the flow port. As this occurs, gravel collects around the shoe track, and fluid returns in the borehole flow back into the shoe track through a screen disposed toward the track's toe. Once inside the shoe track, the fluid returns communicate through a bypass on the shoe track around the sealed outlet and port. At this point, the fluid returns can pass uphole in the gravel pack assembly.

46 Claims, 12 Drawing Sheets

(51) Int. Cl.
*E21B 47/09* (2012.01)
*E21B 34/00* (2006.01)

(56) References Cited

U.S. PATENT DOCUMENTS

| | | | | |
|---|---|---|---|---|
| 4,440,218 | A | 4/1984 | Farley | |
| 4,474,239 | A | 10/1984 | Colomb et al. | |
| 4,570,714 | A * | 2/1986 | Turner et al. | 166/278 |
| 4,646,839 | A * | 3/1987 | Rickey | 166/335 |
| 5,113,935 | A * | 5/1992 | Jones et al. | 166/51 |
| 5,269,375 | A | 12/1993 | Schroeder, Jr. | |
| 5,934,376 | A | 8/1999 | Nguyen et al. | |
| 6,003,600 | A | 12/1999 | Nguyen et al. | |
| 6,230,801 | B1 * | 5/2001 | Hill et al. | 166/278 |
| 6,253,851 | B1 | 7/2001 | Schroeder, Jr. et al. | |
| 6,364,017 | B1 * | 4/2002 | Stout et al. | 166/278 |
| 6,371,210 | B1 | 4/2002 | Bode et al. | |
| 6,405,800 | B1 * | 6/2002 | Walker et al. | 166/278 |
| 6,446,722 | B2 | 9/2002 | Nguyen et al. | |
| 6,488,082 | B2 * | 12/2002 | Echols et al. | 166/51 |
| 6,571,875 | B2 * | 6/2003 | Bissonnette et al. | 166/278 |
| 6,588,507 | B2 | 7/2003 | Dusterhoft et al. | |
| 6,601,646 | B2 | 8/2003 | Streich et al. | |
| 6,675,891 | B2 | 1/2004 | Hailey, Jr. et al. | |
| 6,749,023 | B2 | 6/2004 | Nguyen et al. | |
| 6,782,948 | B2 * | 8/2004 | Echols et al. | 166/278 |
| 6,789,624 | B2 * | 9/2004 | McGregor et al. | 166/278 |
| 6,857,476 | B2 | 2/2005 | Richards | |
| 6,983,795 | B2 | 1/2006 | Zuklic et al. | |
| 7,017,664 | B2 | 3/2006 | Walker et al. | |
| 7,331,388 | B2 | 2/2008 | Vilela et al. | |
| 7,367,395 | B2 | 5/2008 | Vidrine et al. | |
| 7,472,750 | B2 | 1/2009 | Walker et al. | |
| 7,934,553 | B2 * | 5/2011 | Malone | 166/278 |
| 8,056,628 | B2 * | 11/2011 | Whitsitt et al. | 166/278 |
| 8,496,055 | B2 * | 7/2013 | Mootoo et al. | 166/278 |
| 8,596,359 | B2 * | 12/2013 | Grigsby et al. | 166/278 |
| 2001/0047867 | A1 * | 12/2001 | Bissonnette et al. | 166/278 |
| 2003/0000702 | A1 | 1/2003 | Streich | |
| 2003/0037925 | A1 | 2/2003 | Walker et al. | |
| 2003/0047311 | A1 * | 3/2003 | Echols et al. | 166/278 |
| 2003/0070809 | A1 * | 4/2003 | Schultz et al. | 166/278 |
| 2003/0089495 | A1 | 5/2003 | Bixenman | |
| 2004/0134656 | A1 | 7/2004 | Richards | |
| 2004/0211559 | A1 | 10/2004 | Nguyen et al. | |
| 2005/0082060 | A1 * | 4/2005 | Ward et al. | 166/278 |
| 2006/0060352 | A1 * | 3/2006 | Vidrine et al. | 166/276 |
| 2007/0187095 | A1 | 8/2007 | Walker et al. | |
| 2008/0099194 | A1 | 5/2008 | Clem | |
| 2008/0128130 | A1 * | 6/2008 | Whitsitt et al. | 166/278 |
| 2008/0283252 | A1 | 11/2008 | Guignard et al. | |
| 2009/0095471 | A1 | 4/2009 | Guignard et al. | |
| 2009/0133875 | A1 | 5/2009 | Tibbles et al. | |
| 2010/0096130 | A1 | 4/2010 | Parlar et al. | |
| 2010/0263864 | A1 | 10/2010 | Chay et al. | |
| 2010/0294495 | A1 * | 11/2010 | Clarkson et al. | 166/278 |
| 2011/0056686 | A1 * | 3/2011 | Clem | 166/278 |
| 2012/0103606 | A1 * | 5/2012 | van Petegem et al. | 166/278 |

FOREIGN PATENT DOCUMENTS

| | | | |
|---|---|---|---|
| RU | 2374431 | C2 | 8/2008 |
| SU | 1191563 | A | 11/1985 |
| WO | 2005049954 | A2 | 6/2005 |
| WO | 2007126496 | | 11/2007 |

OTHER PUBLICATIONS

Schlumberger, "Alternate Path Screens," obtained from www.slb.com/oilfield, dated Jan. 2004, 4 pages.

Schlumberger, "FloRite—Inflow control device," obtained from www.slb.com/transcend, (c) 2009, 2 pages.

Halliburton, "Sand Control: Horizon Low Density, Lightweight Gravel," obtained from www.halliburton.com, (c) 2006, 2 pages.

Edment, Brian, et al., "Improvements in Horizontal Gravel Packing," Oilfield Review, Spring 2005, pp. 50-60.

Synopsis of SPE 38640 by Jones, L.G., et al., "Shunts Help Gravel Pack Horizontal Wellbores with Leakoff Problems," Journal of Petroleum Technology, Mar. 1998, pp. 68-69.

Coronado, Martin, et al., "Completing extended-reach, open-hole, horizontal well," obtained from http://www.offshore-mag.com/index/article-tools-template, generated on May 12, 2010, 5 pages.

Schlumberger, "ResFlow Inflow Control Devices and MudSolv Filtercake Removal Equalize Inflow and Restart Wells," obtained from www.slb.com/sandcontrol, (c) 2010, 2 pages.

Jensen, Rene, et al., "World's First Reverse-Port Uphill Openhole Gravel Pack with Swellable Packers," SPE 122765, 15 pages.

Weatherford, "Model 4P Retrievable Seal-Bore Packer Gravel-Pack System," obtained from www.weatherford.com, (c) 2005-2009, 2 pages.

Brannon, D.H., et al., "A Single-Trip, Dual-Zone Gravel Pack System Successfully Gravel Packs Green Canyon Area Wells, Gulf of Mexico," SPE 21670, (c) 1991, 7 pages.

Weatherford, "Hydraulic-Release Hookup Nipple Circulating Gravel-Pack System," obtained from www.weatherford.com, (c) 2005, 2 pages.

Weatherford, "Conventional Well Screens," obtained from www.weatherford.com, (c) 2004-2009, 16 pages.

Weatherford, "Model WFX Setting Tools," obtained from www.weatherford.com, (c) 2007-2008, 2 pages.

Weatherford, "Model WFX Crossover Tool," obtained from www.weatherford.com, (c) 2007-2008, 2 pages.

Weatherford, "Real Results: Completion Package Eliminates Sand Production, Enhances Reliability in Siberian Oil-Production Well," obtained from www.weatherford.com, (c) 2009, 1 page.

Decision on Grant in counterpart Russian Appl. No. 2011143515, dated Mar. 7, 2013.

First Office Action received in counterpart Canadian Appl. No. 2,755,623, dated Jun. 14, 2013.

First Office Action received in counterpart Australian Appl. No. 2011236063, dated May 21, 2013.

First Office Action received in counterpart U.S. Appl. No. 12/913,981, dated May 6, 2013.

Response to First Office Action received in counterpart U.S. Appl. No. 12/913,981, dated May 6, 2013.

First Office Action in counterpart Russian Appl. No. 2011143515, dated Nov. 26, 2012.

Extended Search Report received in counterpart European Appl. No. 12184724.8, dated Jan. 9, 2013.

International Search Report and Written Opinion received in corresponding PCT Application No. PCT/US2013/020247, dated Jan. 8, 2014.

Written Opinion received in corresponding Singapore Application No. 11201403347X, dated Apr. 1, 2015.

* cited by examiner 134
132B
150
140B
140A
114
112
110
130B
236

12
110
14
100
140A
140B
130B
150
130A
200C
200C
122
10
170
104
102B
104
102A
120

150
132A
154
200C
140A
220
240
114
112
114
110
214
130A
234
150

GRAVEL PACK BYPASS ASSEMBLY

CROSS-REFERENCE TO RELATED APPLICATIONS

This is a continuation-in-part of U.S. application Ser. No. 12/913,981, filed 28 Oct. 2010, which is incorporated herein by reference in its entirety and to which priority is claimed, and this application claims the benefit of U.S. Provisional application Ser. No. 61/632,403, filed 16 Sep. 2011 and entitled "Single Port Gravel Pack and Sand Disposal Device", which is incorporated herein by reference in its entirety and which was converted to a provisional application from U.S. application Ser. No. 13/234,918, filed 16 Sep. 2011 and entitled "Single Port Gravel Pack and Sand Disposal Device."

This application is filed concurrently with U.S. patent application Ser. No. 13/345,418 and entitled "One Trip Toe-to-Heel Gravel Pack and Liner Cementing Assembly," U.S. patent application Ser. No. 13/345,476 and entitled "Gravel Pack Inner String Adjustment Device," and U.S. patent application Ser. No. 13/345,544 and entitled "Gravel Pack Inner String Hydraulic Locating Device," which are also incorporated herein by reference in their entireties.

BACKGROUND

Some oil and gas wells are completed in unconsolidated formations that contain loose fines and sand. When fluids are produced from these wells, the loose fines and sand can migrate with the produced fluids and can damage equipment, such electric submersible pumps (ESP) and other systems. For this reason, completions can require screens for sand control.

Horizontal wells that require sand control are typically open hole completions. In the past, stand-alone sand screens have been used predominately in these horizontal open holes. However, operators have also been using gravel packing in these horizontal open holes to deal with sand control issues. The gravel is a specially sized particulate material, such as graded sand or proppant, which is packed around the sand screen in the annulus of the borehole. The gravel acts as a filter to keep any fines and sand of the formation from migrating with produced fluids.

A prior art gravel pack assembly 20 illustrated in FIG. 1A extends from a packer 14 downhole from casing 12 in a borehole 10, which is a horizontal open hole. To control sand, operators attempt to fill the annulus between the assembly 20 and the borehole 10 with gravel (particulate material) by pumping slurry of fluid and gravel into the borehole 10 to pack the annulus. For the horizontal open borehole 10, operators can use an alpha-beta wave (or water packing) technique to pack the annulus. This technique uses a low-viscosity fluid, such as completion brine, to carry the gravel. The assembly 20 in FIG. 1A represents such an alpha-beta type.

Initially, operators position a wash pipe 40 into a screen 25 and pump the slurry of fluid and gravel down an inner work string 45. The slurry passes through a port 32 in a crossover tool 30 and into the annulus between the screen 25 and the borehole 10. As shown, the crossover tool 30 positions immediately downhole from the gravel pack packer 14 and uphole from the screen 25. The crossover port 32 diverts the flow of the slurry from the inner work string 45 to the annulus downhole from the packer 14. At the same time, another crossover port 34 diverts the flow of returns from the wash pipe 40 to the casing's annulus uphole from the packer 14.

As the operation commences, the slurry moves out the crossover port 32 and into the annulus. The carrying fluid in the slurry then leaks off through the formation and/or through the screen 25. However, the screen 25 prevents the gravel in the slurry from flowing into the screen 25. The fluids passing alone through the screen 25 can then return through the crossover port 34 and into the annulus above the packer 14.

As the fluid leaks off, the gravel drops out of the slurry and first packs along the low side of the borehole's annulus. The gravel collects in stages 16*a*, 16*b*, etc., which progress from the heel to the toe in what is termed an alpha wave. Because the borehole 10 is horizontal, gravitational forces dominate the formation of the alpha wave, and the gravel settles along the low side at an equilibrium height along the screen 25.

When the alpha wave of the gravel pack operation is done, the gravel then begins to collect in stages (not shown) of a beta wave. This forms along the upper side of the screen 25 starting from the toe and progressing to the heel of the screen 25. Again, the fluid carrying the gravel can pass through the screen 25 and up the wash pipe 40. To complete the beta wave, the gravel pack operation must have enough fluid velocity to maintain turbulent flow and move the gravel along the topside of the annulus. To recirculate after this point, operators have to mechanically reconfigure the crossover tool 30 to be able to washdown the pipe 40.

Although the alpha-beta technique can be economical due to the low-viscosity carrier fluid and regular types of screens that can be used, some situations may require a viscous fluid packing technique that uses an alternate path. In this technique, shunts disposed on the screen divert pumped packing slurry along the outside of the screen. FIG. 1B shows an example assembly 20 having shunts 50 and 52 (only two of which are shown). Typically, the shunts 50/52 for transport and packing are attached eccentrically to the screen 25. The transport shunts 50 feed the packing shunts 52 with slurry, and the slurry exits from nozzles 54 on the packing shunts 52. By using the shunts 50/52 to transport and pack the slurry, the gravel packing operation can avoid areas of high leak off in the borehole 10 that would tend to cause bridges to form and impair the gravel packing.

Prior art gravel pack assemblies 20 for both techniques of FIGS. 1A-1B have a number of challenges and difficulties. During a gravel pack operation in a horizontal well, for example, the crossover ports 32/34 may have to be re-configured several times. During a frac pack operation, the slurry pumped at high pressure and flow rate can sometimes dehydrate within the assembly's crossover tool 30 and associated sliding sleeve (not shown). If severe, settled sand or dehydrated slurry can stick to service tools and can even junk the well. Additionally, the crossover tool 30 is subject to erosion during frac and gravel pack operations, and the crossover tool 30 can stick in the packer 14, which can create extremely difficult fishing jobs.

To deal with gravel packing in some openhole wells, a Reverse-Port Uphill Openhole Gravel Pack system has been developed as described in SPE 122765, entitled "World's First Reverse-Port Uphill Openhole Gravel Pack with Swellable Packers" (Jensen et al. 1009). This system allows an uphill openhole to be gravel packed using a port disposed toward the toe of the hole.

The subject matter of the present disclosure is directed to overcoming, or at least reducing the effects of, one or more of the problems set forth above.

SUMMARY

An excess slurry disposal apparatus and method of a gravel pack operation disposes of excess slurry from an inner string into the annulus around a gravel pack assembly. In general, the apparatus has a body with a body passage communicating from a heel to a toe, and part of the body towards the toe can have a shoe track with a float shoe. The body, however, can be any part of the gravel pack assembly disposed at some point in the borehole and does not necessarily need to be disposed at the shoe track. Nevertheless, reference may be made to the body being at or part of a shoe track for convenience.

The shoe track (i.e., body) defines flow ports communicating the body passage outside the shoe track to the surrounding borehole annulus. First seats disposed inside the shoe track's passage allow seals on the inner string to seal the string's outlet ports in fluid communication with the track's flow ports. A bypass disposed on the shoe track communicates the body passage on one side of the flow ports to the other side. For example, this bypass can be an internal conduit or passage communicating the downhole end of the shoe track's inner passage with the uphole end. Alternatively, the bypass can be an external conduit, such as a shunt tube, disposed outside the shoe track and extending from the one side of the flow ports to the other.

A closure is disposed on the shoe track and can control or selectively open and close fluid communication through the flow ports. In general, the closure can be a check valve, a sliding sleeve, a rotating sleeve, a rupture disk, a screen, etc. As a sliding sleeve, for example, the closure can be moved by a shifting tool on the inner string to open or close fluid communication through the flow ports. Movement of the sleeve can also open and close fluid communication through the bypass. Alternatively, the bypass can always remain open and allow for fluid flow therethrough.

When the closure is open and the string's outlet ports are sealed in fluid communication with the shoe track's flow ports, excess slurry in the inner string can be pumped into the borehole annulus around the shoe track by flowing the excess slurry from the string's outlet ports and into the borehole annulus through the track's flow ports. As this occurs, excess gravel collects around the shoe track, and fluid returns in the borehole annulus flow back into the shoe track through a screen disposed on the shoe track between the flow ports and the toe.

As the fluid returns pass through it, the screen prevents at least some particulates in the fluid returns from passing into the shoe track so the gravel will fill the borehole annulus around the shoe track. Once inside the shoe track, the fluid returns bypass uphole of the sealed outlet ports and flow ports by going uphole through the bypass around the flow ports. At this point, the fluid returns can pass uphole in the gravel pack assembly.

The shoe track can have a float shoe at the track's toe. For a washdown operation, the inner string can be moved to a selective position in the shoe track to seal one of its seals on one of the shoe track's seats. This isolates the tool's outlet portions to the float shoe so washdown fluid can be pumped out of the shoe track and around the borehole annulus.

The apparatus having the shoe track can include other components for gravel pack operations. For example, parts of the apparatus uphole of the shoe track can have additional flow ports, seats, and screens. The inner string can be moved to selective positions in the apparatus to seal the string's outlet ports with these other flow ports, and the inner string can communicate slurry from the outlet ports to the borehole annulus. The flow of slurry at these other flow ports can be used to gravel or frac pack the borehole around different portions of the apparatus in a toe-to-heel gravel packing operation. Some of these different portions of the apparatus can also be isolated from one another with packers or the like.

The foregoing summary is not intended to summarize each potential embodiment or every aspect of the present disclosure.

BRIEF DESCRIPTION OF THE DRAWINGS

FIGS. 6C-1 and 6C-2 show a representative cross-section of the bypass assembly of FIG. 5 with the sliding sleeve able to open and close both the bypass channels and flow ports; and FIGS. 6D-1 through 6D-4 show representative cross-sections of the bypass assembly of FIG. 5 with disclosed devices other than a sliding sleeve.

FIGS. 10A-100 show how the disclosed bypass assembly can be incorporated into one of the gravel pack sections of an assembly.

DETAILED DESCRIPTION

Figure 1A:
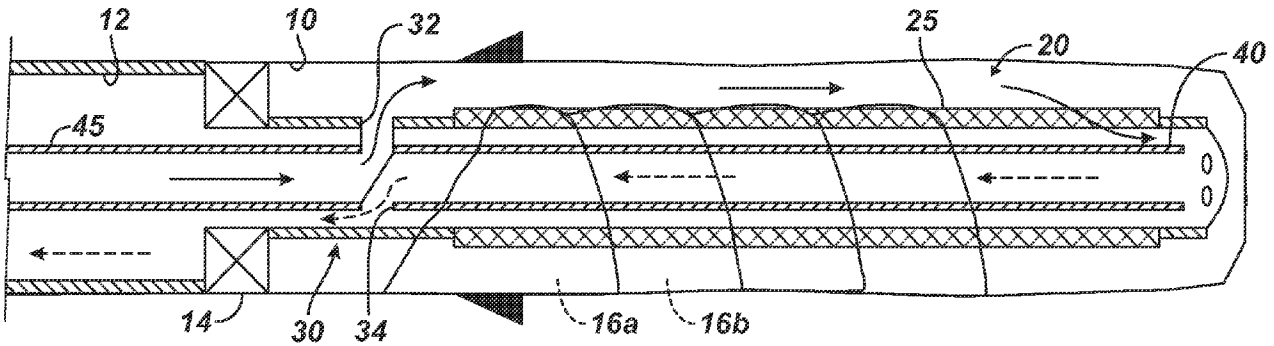
FIG. 1A (Prior Art)
FIGS. 1A-1B illustrate gravel pack assemblies according to the prior art.
Figure 1B:
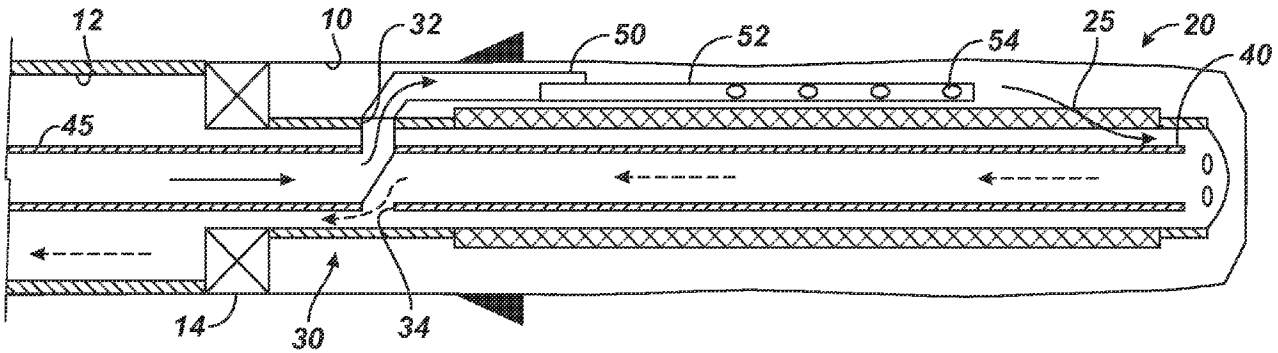
FIG. 1B (Prior Art)
Figure 2:
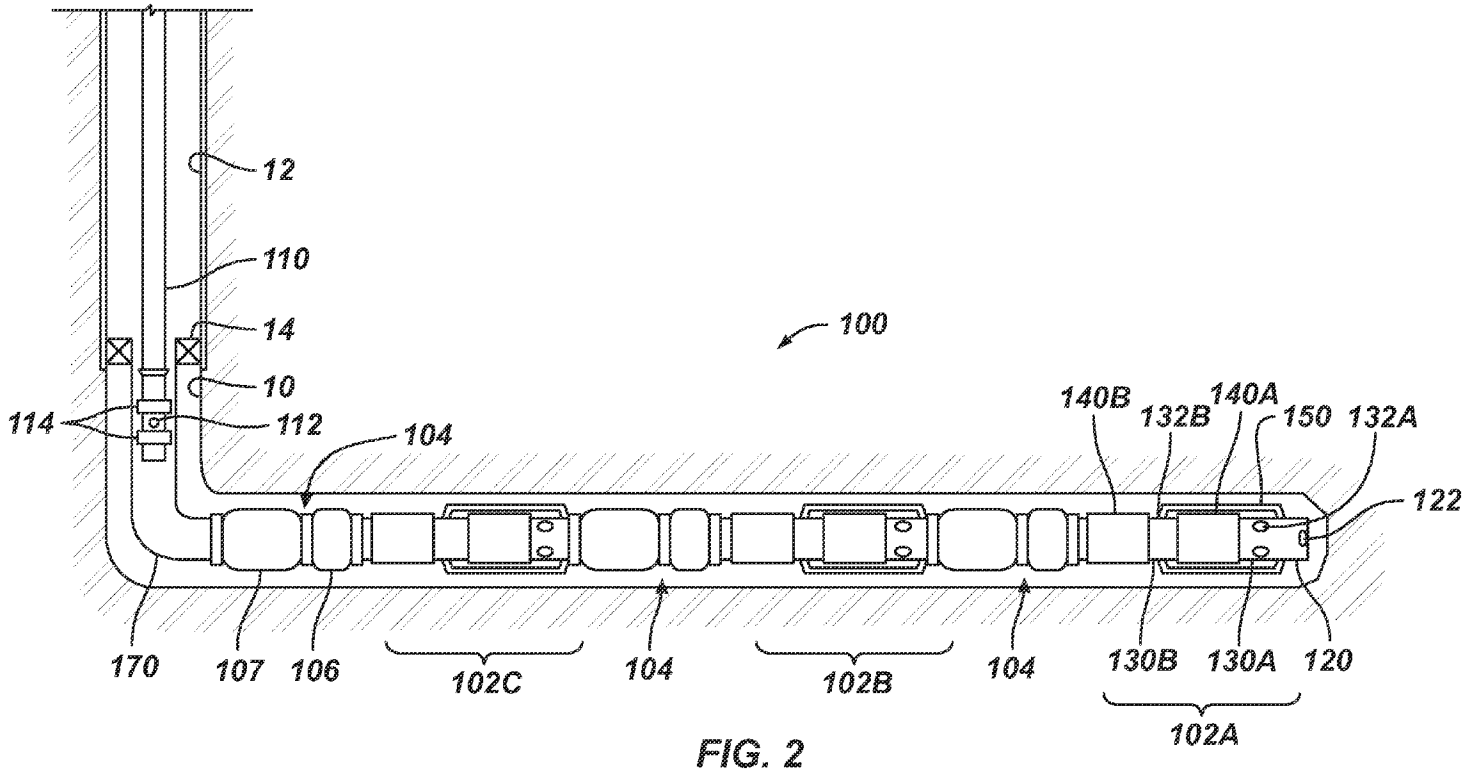
FIG. 2 shows a gravel pack assembly according to the present disclosure having screen sections separated by packers.

FIG. 2 shows a gravel pack assembly 100 having a liner 170 extending from a liner hanger 14 and having several gravel pack sections 102A-C separated by isolating elements 104. The assembly 100 segments several compartmentalized reservoir zones so that multiple gravel or frac pack operations can be performed separately in each zone. The isolating elements 104 and gravel pack sections 102A-C are deployed into the well in a single trip. The isolating elements 104, referred to herein as packers for convenience, can have one packer or a combination of packers to isolate the gravel pack sections 102A-C from one another. Any suitable packers can be used and can include hydraulic or hydrostatic packers 106 and swellable packers 107, for example, used alone or in combination with one another as shown.

Each gravel pack section 102A-C can be similar to the gravel pack assemblies disclosed in incorporated U.S. patent application Ser. No. 12/913,981. As such, each gravel pack section 102A-C has two screens 140A-B, alternate path devices or shunts 150, and housings 130A-B with flow ports 132A-B, although any of the other disclosed variations can be used. In addition, each section 102A-C can have other components disclosed in incorporated U.S. patent application Ser.

No. 12/913,981. Finally, various details on how a service tool is used to set a packer on the liner hanger 14 and how other steps are performed are discussed in detail in the incorporated U.S. patent application Ser. No. 12/913,981, so they are not repeated here.

Turning briefly to gravel pack operations of the assembly 100, an inner string 110 initially deploys in the first gravel pack section 102A and performs a washdown. After washdown and setting of the packers 104, the assembly 100 can commence with gravel or frac pack operations. The string's outlet ports 112 with its seals 114 isolate in fluid communication with the lower flow ports 132A in the first gravel pack section 102A to gravel or frac pack the surrounding zone in a toe-to-heel configuration.

Once packing is completed at these ports 132A, the inner string 110 can again be moved so that the outlet ports 112 isolates to upper flow ports 132B connected to the shunts 150. Slurry pumped down the inner string 110 can then fill the annulus around the lower end of the first gravel pack section 102A. Operations can then proceed with similar steps being repeated up the hole for each of the gravel pack sections 102B-C separated by the packers 104.

Figure 3A:
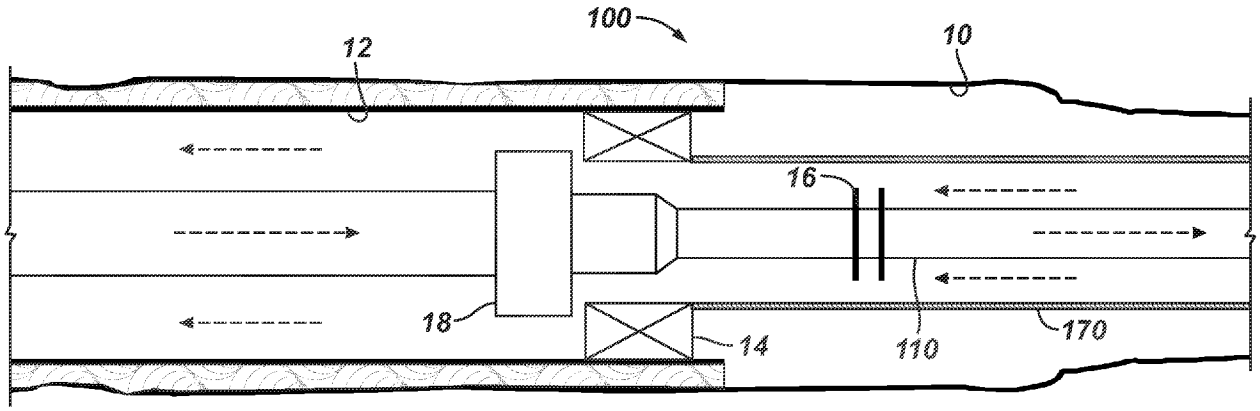
FIGS. 3A-3B show portions of the gravel pack assembly in FIG. 2 during a washdown operation.
Figure 3B:
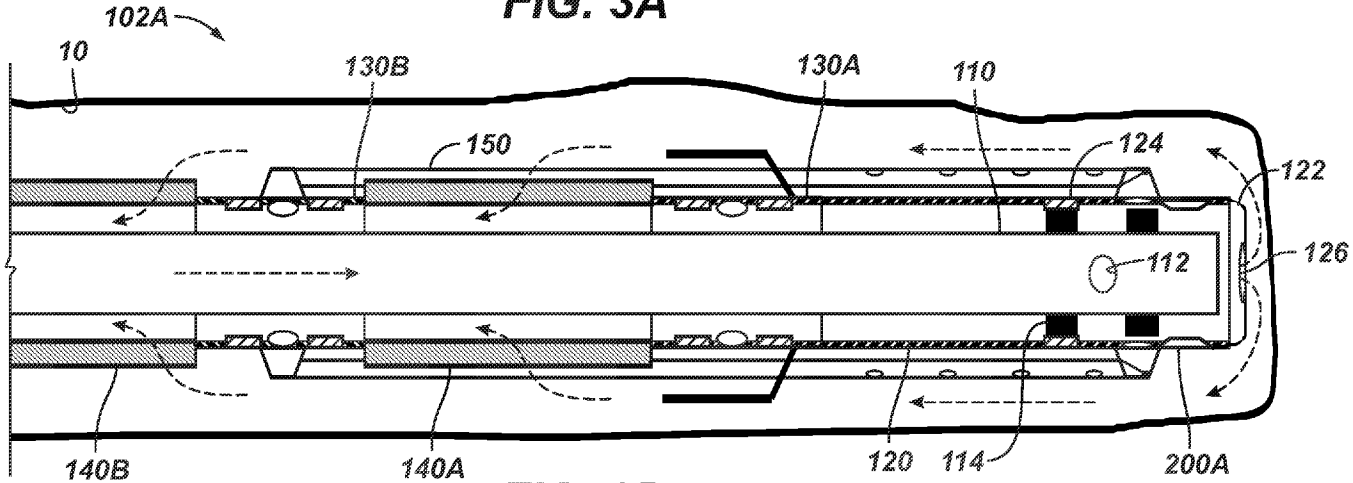

As noted above, operators initially perform a washdown operation with the assembly 100 before gravel packing. As shown in FIGS. 3A-3B, portions of the assembly 100 are shown set up for a washdown operation. Uphole in FIG. 3A, the service tool 18 sits on the liner hanger 14 in the casing 12, and seals 16 on the service tool 18 do not seal in the liner hanger 14 so hydrostatic pressure can be transmitted past the seals 16. Downhole in FIG. 3B, the distal end of the inner string 110 fits through the screen sections 140A-B of the lower section 102A, and one of the string's seals 114 seals against a seat 124 near a float shoe 122 on the assembly's shoe track 120.

Operators circulate fluid down the inner string 110, and the circulated fluid flows out the check valve in the float shoe 122, up the annulus, and around the unset packer of the liner hanger 14 (FIG. 3A). Fluid returns can also flow in the assembly 100 through the screens 140A-B and flow uphole past the liner hanger 14.

Downhole, a bypass 200A is disposed near the float shoe 122 and can allow circulated fluid to pass to the borehole annulus during this process. The bypass assembly 200A can be a check valve, a screen portion, a movable sleeve, or other suitable device that allows flow of returns and not gravel from the borehole annulus to enter the assembly 100. In fact, the bypass assembly 200A as a screen portion can have any desirable length along the shoe track 120 depending on the implementation.

During the washdown, the bypass 200A (if a screen or the like) can allow the circulated fluid to flow out of the shoe track 120 and into the borehole annulus, as circulated fluid is also allowed to pass out of the float shoe 122. If the bypass 200A uses a check valve that allows fluid returns into the shoe track 120, fluid flow out of the bypass 200A can be restricted during washdown. If the bypass 200A uses a movable sleeve, fluid flow in and out of the bypass 200A can be restricted during washdown by having the sleeve closed, which can be done with a suitable shifter on the inner string 110, for example.

After washdown, gravel packing can then be performed by moving the inner string 110 to the flow ports 132A to gravel pack the borehole annulus from toe-to-heel. After gravel packing at this first position, the inner string 110 can then be moved to the next flow ports 132B to further gravel pack the annulus around the shoe track and/or to dispose of excess slurry from the inner string 110.

As discussed in the incorporated U.S. patent application Ser. No. 12/913,981, for example, operators can evacuate excess slurry from the inner string 110 during gravel packing operations. The exterior space outside the shoe track 120 provides a volumetric space for disposing of any excess gravel remaining in the inner string 110 after gravel packing one or more sections 102A-B. Operators may also intentionally gravel pack around the shoe track 120 as opposed to using it for disposing of excess slurry.

Because the shoe track 120 has the float shoe 122 that allows fluid flow out of the shoe track 120 and prevents flow into the shoe track 120, a path for return fluids is needed when slurry is pumped into the borehole annulus around the shoe track 120 to dispose of the excess slurry from the inner string 110. To illustrate how slurry can be disposed around the shoe track 120, reference is made to FIGS. 4A-4B, which show portions of the assembly 100 set up for sand disposal.

As shown during sand disposal, operators deploy the inner string 110 to the second flow ports 132B on the gravel pack section 102A having the shoe track 120. This can be done after operators have reached sandout while pumping slurry at the section's first flow ports 132A in the first ported housing 130A or after gravel packing has been performed on other gravel pack sections (e.g., sections 102B-C on the assembly 100 of FIG. 2). In any event, operators perform a sand disposal operation to clear the inner string 110 of excess slurry or to intentionally gravel pack around the shoe track 120.

Figure 4A:
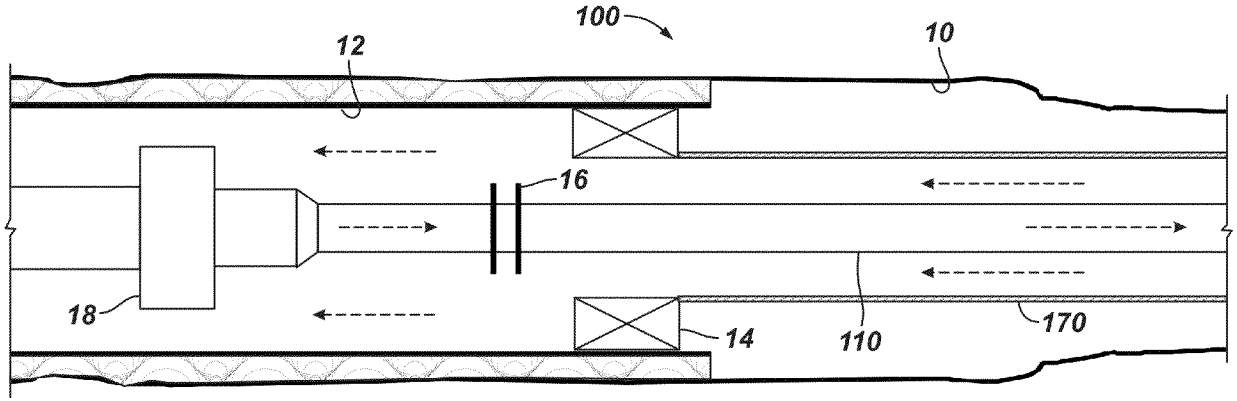
FIGS. 4A-4B show portions of the gravel pack assembly in FIG. 2 during filling of the annulus around the shoe track.
Figure 4B:
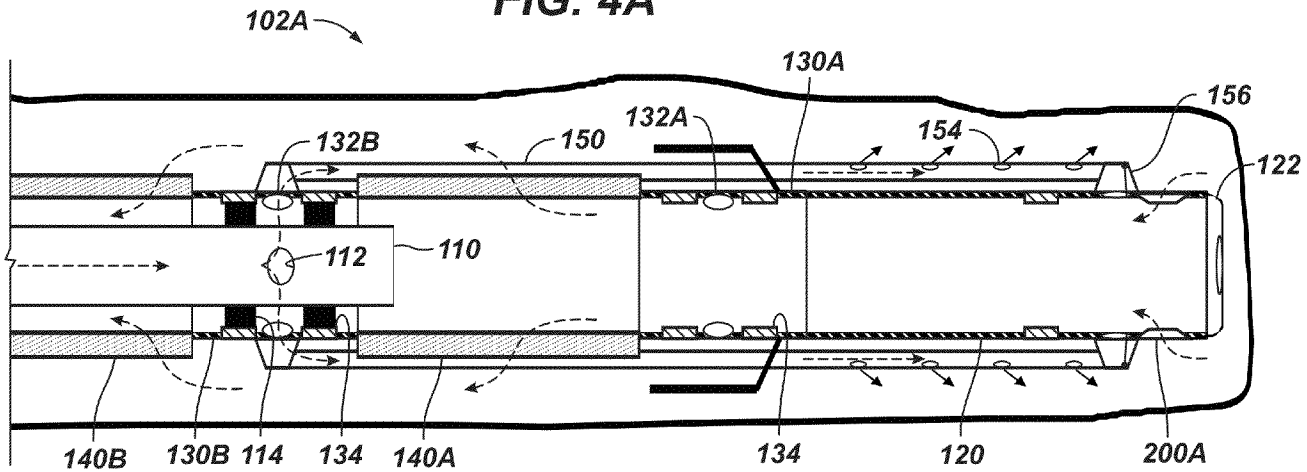

To do this, operators position the inner string 110 as shown in FIGS. 4A-4B. Here, the string's seals 114 engage the seats 134 around the second flow ports 132B between the screen sections 140A-B. Operators then pump slurry down the inner string 110 to the outlet ports 112, and the slurry flows from the outlet ports 112 and through the housing's flow ports 132B.

In general, the slurry can flow directly out of the flow ports 132B and into the surrounding annulus if desired. This is possible if one or more of the flow ports 132B communicate directly with the annulus and do not communicate with one of the alternate path devices or shunt 150. All the same, the slurry can flow out of the flow ports 132B and into the alternate path devices or shunts 150 for placement elsewhere in the surrounding annulus. As shown here, the shunts 150 can deliver the slurry toward the toe around the shoe track 120. Although shunts 150 are depicted in a certain way, any desirable arrangement and number of transport and packing devices for an alternate path can be used to feed and deliver the slurry.

Depending on the implementation, this second stage of pumping slurry may be used to further gravel pack the borehole 10. Alternatively as noted previously, pumping the slurry through the shunts 150 enables operators to evacuate excess slurry from the string 110 to the borehole annulus around the shoe track 120 without reversing flow in the string from the main flow direction (i.e., toward the string's ports 112). This is in contrast to the typical practice of reversing the direction of flow by pumping fluid down an annulus to evacuate excess slurry from a string.

To that end, the shunts 150 attached to the ported housing 130B above the lower screen section 140A can be used to dispose of excess gravel from the inner string 110 around the shoe track 120 (and optionally inside the shoe track 120 itself). As shown in FIG. 4B, the slurry travels from the outlet ports 112, through flow ports 132B, and through the shunts 150. From the shunts 150, the slurry then passes out side ports or nozzles 154 in the shunts 150 and fills the annulus around shoe track 120. This provides the gravel packing operation with an alternate path different from the assembly's primary path of toe-to-heel packing of the annulus with gravel.

The shunts 150 carry the slurry down the lower screen section 140A so a wash pipe does not need to be disposed in the shoe track 120. However, the bypass assembly 200A disposed in the assembly 100 near the float shoe 122 allows fluid during this process to enter the assembly 100.

As noted previously, the bypass assembly 200A can be a check valve, a screen portion, a sleeve, or other suitable device that allows the flow of fluid returns and not gravel from the borehole to enter the assembly 100. As a screen, the bypass assembly 200A can have any desirable length along the shoe track 120 depending on the implementation so that the depicted size of the bypass assembly 200A is merely meant to be a representation.

Fluid returns enter the shoe track 120 through this bypass assembly 200A, and the returns flow out the first screen section 140A, through surrounding gravel, and back in the upper screen section 140B. This allows the fluid returns to go around the sealed ports 112 and 132B. The fluid returns can then flow uphole in the annulus between the inner string 110 and assembly 100, eventually reaching the liner hanger 14 and unset service tool 18.

At some point, operations may reach a "sand out" condition or a pressure increase while pumping slurry at the flow ports 132B. At this point, a valve, rupture disc, or other closure device 156 in the shunts 150 can open so the gravel in the slurry can then fill inside the shoe track 120 after evacuating excess gravel around the shoe track 120. In this way, operators can evacuate more excess gravel inside the shoe track 120. As this occurs, fluid returns can pass out the lower screen section 140A, through the packed gravel, and back through upper screen section 140B to travel uphole.

In other arrangements of a bypass assembly, the lower ported housing 130A or other portions of the gravel pack assembly 100 can have a bypass, another shunt, or the like, which can be used to deliver fluid returns past the seals 114 and seats 134 and uphole. Details of other bypass assemblies according to the present disclosure are discussed later.

Figure 5:
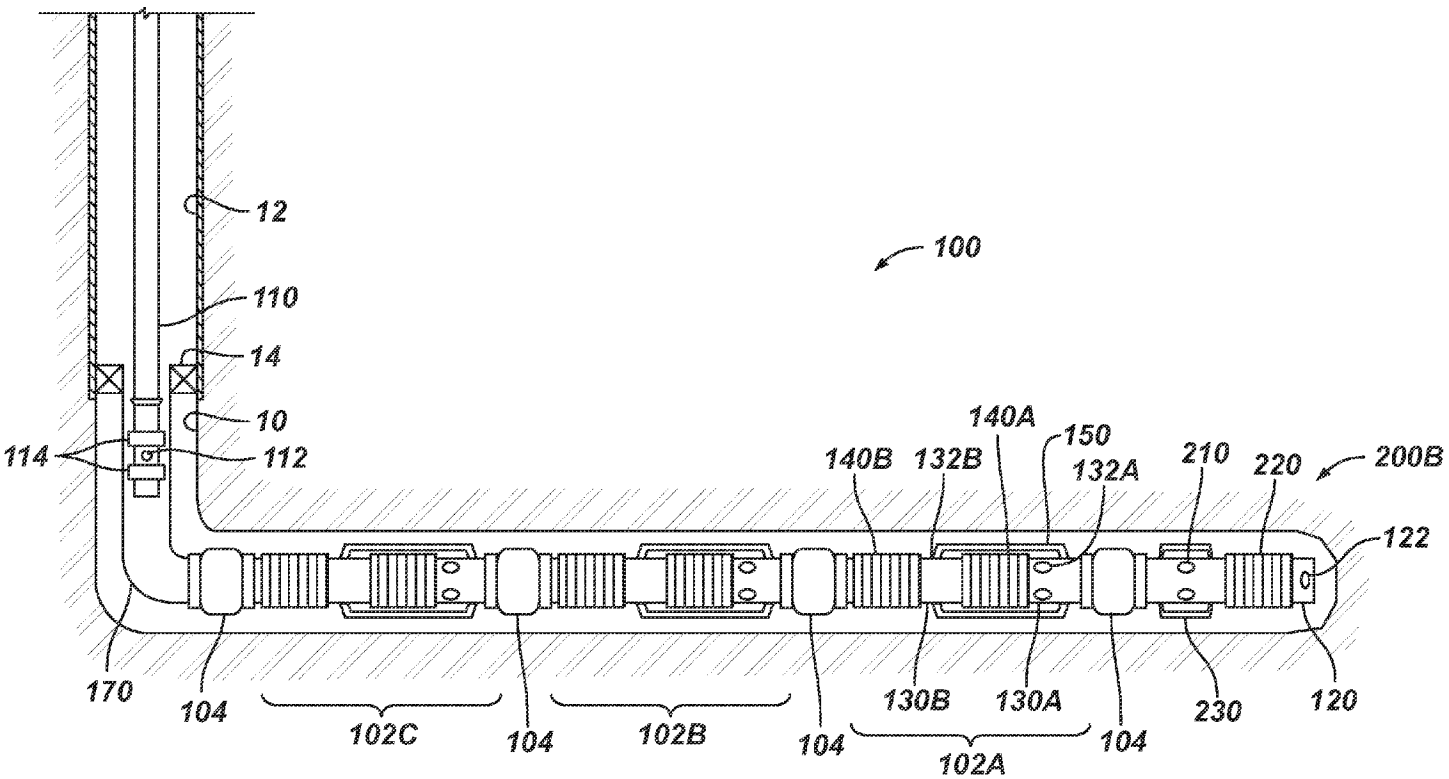
FIG. 5 shows another gravel pack assembly according to the present disclosure having screen sections separated by packers and having a bypass assembly disposed on the shoe track.

FIG. 5 shows another gravel pack assembly 100 having a liner 170 extending from a liner hanger 14 and having several gravel pack sections 102A-C separated by packers 104 disposed in a borehole 10. As before, this gravel pack assembly 100 can be similar to that discussed previously and to those disclosed in incorporated U.S. patent application Ser. No. 12/913,981.

The assembly 100 has another embodiment of a shoe track 120 having a bypass assembly 200B at the end of the gravel pack assembly 100. As shown, the bypass assembly 200B and shoe track 120 can be a separate section on the gravel pack assembly 100, being separated from the gravel pack sections 102A-B by one or more packers 104. Alternatively, the bypass assembly 200B can be incorporated into the gravel pack section 102A at the end of the assembly 100 without being separate from the section 102A in a way similar to the other bypass arrangement of FIGS. 3A-3B and 4A-4B.

After gravel packing other gravel pack sections 102A-B, operators preferably evacuate excess slurry from the inner string 110 as noted previously and use the exterior space outside the shoe track 120 for disposing of any gravel remaining in the inner string 110. Accordingly, the inner string 110 deploys to the shoe track 120, and excess slurry is pumped down and out of the inner string 110 and into the borehole annulus around the shoe track 120 as discussed previously. Meanwhile, the bypass assembly 200B allows fluid returns to enter a lower screen 220 and bypass the inner string's ports 112 so the fluid returns can go uphole to the surface.

Figure 6A:
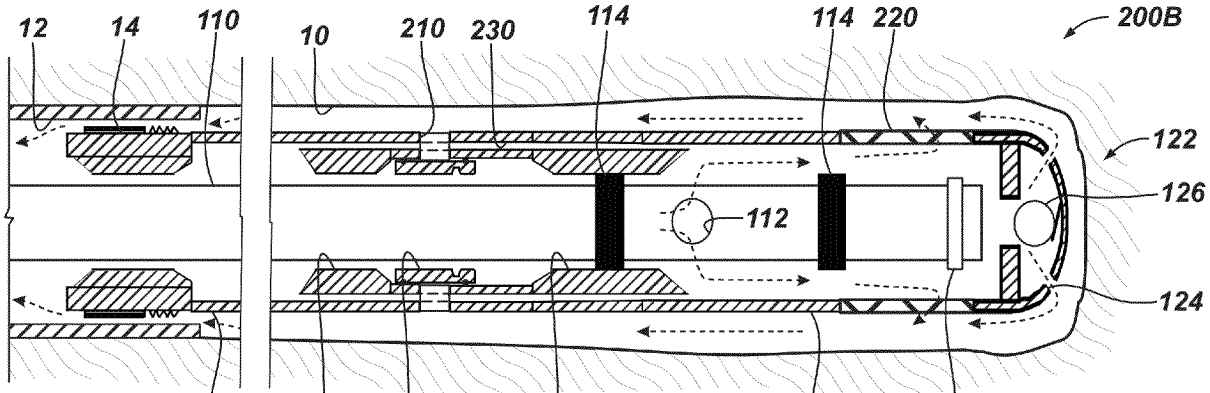
FIG. 6A shows portions of the gravel pack assembly in FIG. 5 during a washdown operation.
Figure 7:
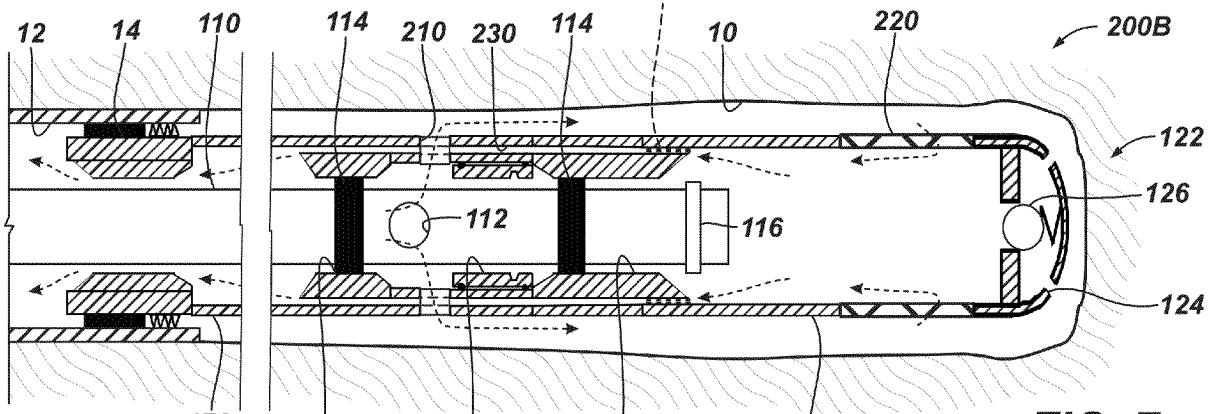
FIG. 7 shows portions of the gravel pack assembly in FIG. 5 during a sand disposal operation.

Further details of the shoe track 120 and bypass assembly 200B are shown in FIGS. 6A through 7. Looking first at FIG. 6A, the bypass assembly 200B has flow ports 210, a screen 220, and a bypass channel 230. The flow ports 210 communicate with the borehole annulus. To control fluid flow through these flow ports 210, internal seats 214 are disposed uphole and downhole of the flow ports 210 for engaging seals of the inner string as discussed below. A reverse arrangement could also be used in which internal seals disposed uphole and downhole of the flow ports 210 can engages seats of the inner string.

As a further option to control flow through the flow ports 210, the bypass assembly 200B also has a closure 240 as shown. The closure 240 can selectively open and close fluid communication through the flow ports 210. When closed, for example, the closure 240 prevents fluid returns, annulus fluids, gravel, and the like from passing back into the shoe track 120 during washdown, production, or other operations. When opened, however, the closure 240 allows slurry to pass out of the flow ports 210 so gravel can pack around the shoe track 120 in the borehole annulus. Although shown in FIG. 6A, use of the closure 240 may not be necessary in all implementations. In other words, controlling fluid communication can be achieved merely by the positioning the seals on the inner string within the bypass assembly 200B (or by the positioning ports on the inner string relative to seals on the bypass assembly 200B).

Figure 6B:
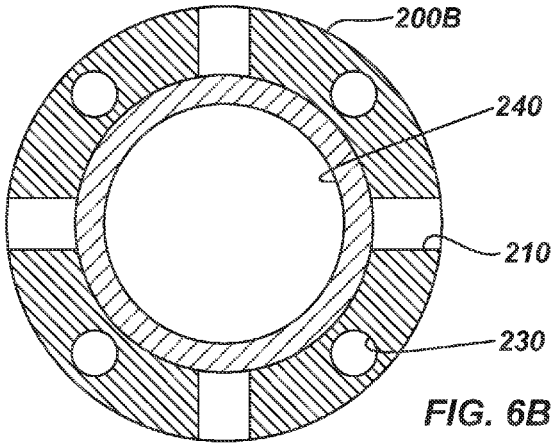
FIG. 6B shows a representative end-section of the bypass assembly of FIG. 5 with a sliding sleeve, bypass channels, and flow ports.
Figures 1, 6C:
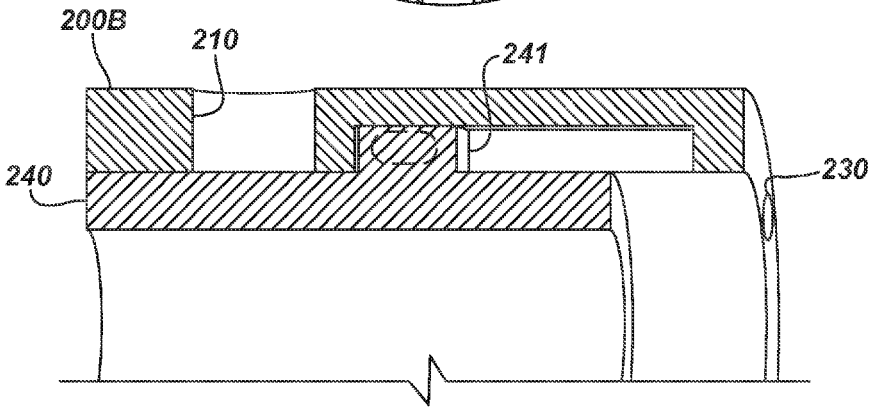
Figures 2, 6C:
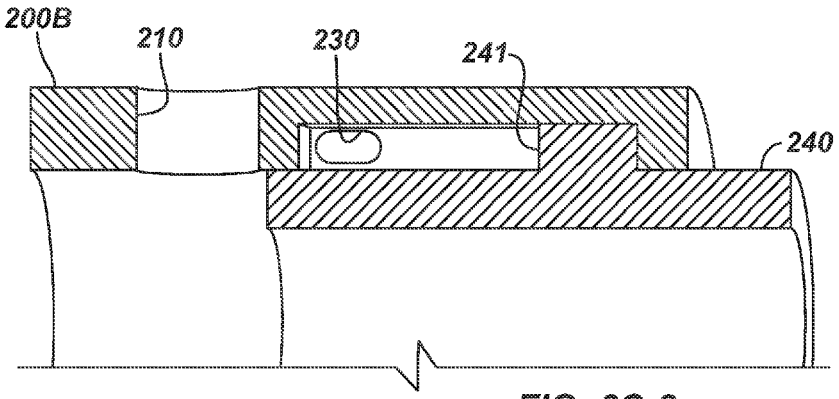
Figures 1, 6D:
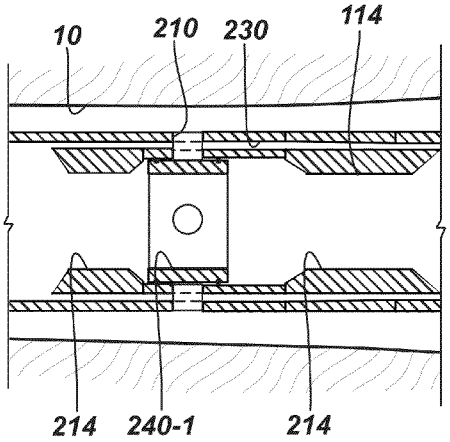
Figures 3, 6D:
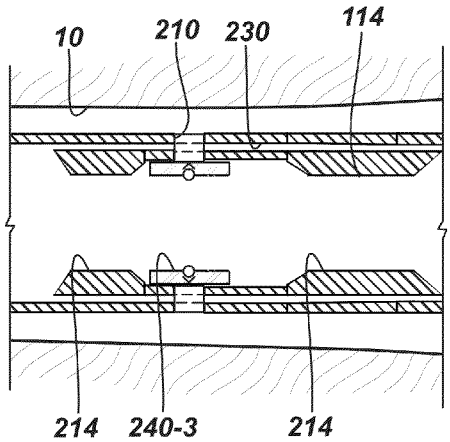
Figures 2, 6D:
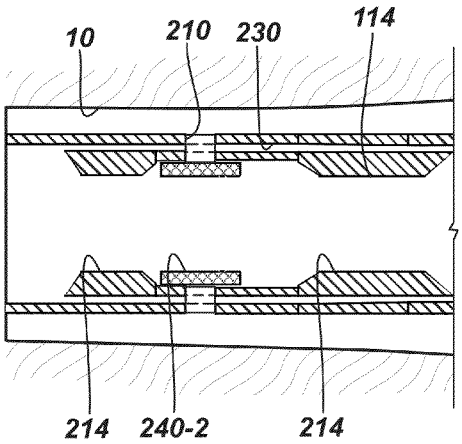
Figures 4, 6D:
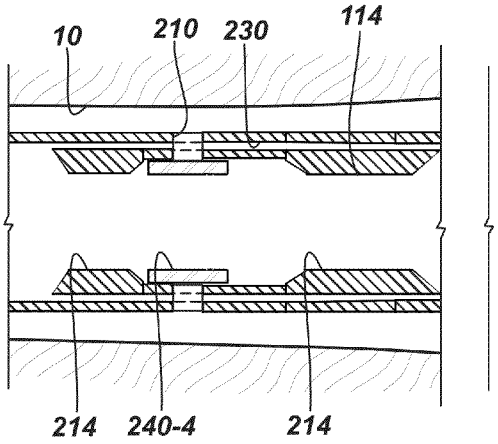

Various forms of closure 240 could be used to control or selectively open and close fluid communication through the flow ports 210. For example, the closure 240 can include a sliding sleevel (FIG. 6A), a rotating sleeve (240-1: FIG. 6D-1), a screen (240-2: FIG. 6D-2), a check valve (240-3: FIG. 6D-3), allowing flow out but not into the shoe track 120, a rupture disk (240-4: FIG. 6D-4), or other device for selectively permitting/restricting fluid communication through the flow ports 210. These can be used alone or in combination with one another. As specifically shown in FIG. 6A, the closure 240 is a sliding sleeve that can be shifted opened and closed relative to the flow ports 210. Shifting of the sliding sleeve 240 can be achieved using a shifting tool 116 known in the art.

The bypass channels 230 in this arrangement are internal channels or passages that are defined in the bypass assembly 200B and bypass the seats 214 and the flow ports 210. Although shown intersecting, the flow ports 210 and bypass channels 230 are actually offset from one another around the circumference of the shoe track 120 so that they do not intersect with one another. For example, FIG. 6B shows a representative end-section of the bypass assembly 200B with the bypass channels 230 and outlet ports 210 offset around the circumference of the bypass assembly 200B. Other configurations could be used.

As noted above, the sliding sleeve 240 can move inside the assembly 200B to open or close the flow ports 210. As such, the bypass channels 230 may always remain open, while the flow ports 210 can be opened and closed. As an alternative, movement of the sliding sleeve 240 can also open and close fluid communication through the bypass channels 230. For example, FIGS. 6C-1 and 6C-2 shows representative cross-sections of the bypass assembly 200B with the sliding sleeve 240 movable in the assembly 200B.

When the sleeve 240 as shown in FIG. 6C-1 is moved to close the flow ports 210, a portion of the sleeve 240 closes off the channels 230 in the assembly 200B. In this example, the channels 230 can run longitudinally through the assembly 200B and can have a portion that runs circumferentially. A valve, stem, or other member 241 of the sleeve 240 can close off fluid communication through the circumferential portion of the channel 230. By contrast, when the sleeve 240 as shown in FIG. 6C-2 is moved to open the output ports 210, the valve 241 of the sleeve 240 opens fluid communication of the channels 230 in the assembly 200B.

FIGS. 6C-1 and 6C-2 are merely representative of one way to open and close fluid communication for both the flow ports 210 and the channels 230 with the movement of the sleeve 240. With the benefit of the present disclosure, those skilled in the art will appreciate that various sub assemblies, seals, and the like would be needed to construct the representations and will also appreciate that other arrangements could be used to open and close the flow ports 210 and channels 230 with a sliding sleeve or other closure 240 according to the present disclosure.

For its part, the screen 220 in FIG. 6A can be any suitable screen for use downhole and can be a wire-wrapped screen, a slotted liner, a mesh screen, etc. Moreover, the screen 220 can have any desirable length along the shoe track 120 depending on the implementation. Together, the screen 220 and bypass channels 230 allow fluid returns during the sand disposal operation described below to return up the annulus between the inner string 110 and the shoe track 120.

Turning with more specificity now to FIG. 6A, the assembly 100 with the shoe track 120 and bypass assembly 200B is shown set up for an initial washdown operation. The inner string 110 deploys in the shoe track 120, and one of the seals 114 on the end of the inner string 110 seals inside the shoe track 120 against the downhole seat 214. Operators pump washdown fluid through the inner string 110, and the circulated fluid passes the check valve 126 in the float shoe 122 and passes out the shoe's ports 124.

As the circulated fluid flows out the float shoe 122, the fluid then passes up the annulus and around the unset packer of the liner hanger 14 uphole on the assembly 100. The circulated fluid may also flow out of the bypass assembly's screen 220, which may not be an issue during the washdown procedure. The closed sleeve 240 on the shoe track 120, however, closes off the flow ports 210 on the shoe track 120. Additionally, the closed sleeve 240 can close off communication through the bypass channel 230 if arranged to do so.

Turning now to FIG. 7, the assembly 100 with the shoe track 120 and bypass assembly 200B is shown set up for a sand disposal operation. As discussed before, operators preferably evacuate excess slurry from the inner string 110 after gravel packing one or more sections (102) and can use the exterior space outside the shoe track 120 for disposing of any slurry remaining in the inner string 110.

As shown in FIG. 7, the inner string's seals 114 locate and seal on the seats 214 uphole of the bypass screen 220 in the sand disposal position. The seals 114 can use elastomeric or other types of seals disposed on the inner string 110, and the seats 214 can be polished seats or surfaces inside the shoe track 120 to engage the seals 114. Slurry is pumped through the inner string 110, and the pumped slurry exits from the string 110 and passes through the ports 112 and 210, which direct the slurry into the borehole annulus. As this occurs, the slurry begins to fill the annulus around the float shoe 120. (A shunt 150 or the like could be used to direct the slurry if desired.)

As the slurry fills the annulus, fluid returns then flow through the screen 220, which prevents the gravel from entering the gravel pack assembly 100. The returns then flow up the shoe track 120 to the bypass channels 230. Here, the bypass channels 230 allow the fluid returns to flow up from the shoe track 120 and past the closure 240, the seats 214, and the flow ports 210. This allows the fluid returns to go around the engaged seals 114 and seats 214, circumventing the flow out the inner string 210. As noted previously, the bypass channels 230 can always be opened, or they can be opened and closed by movement of the sleeve 240. In other words, shifting of the sliding sleeve 240 can open and close fluid communication through the bypass channel 230 as well as the flow ports 210.

Leaving the bypass channels 230 uphole of the seats 214 and seals 114, the fluid returns exit into the annulus between the inner string 110 and the liner 170. Eventually, the fluid returns pass out of the liner 170 to the casing 12. In this way, the fluid returns can be delivered all the way uphole in the assembly 100 without needing to enter the inner string 110.

To prevent any potential sand from entering the bypass channels 230, the channels' entrances can be protected with sand screens 231. As is known, sand capable of collecting above the inner string 110 could cause the string 110 to stick. Therefore, addition of a screen 231 at the entrance of the bypass channels 230 could further prevent sand from flowing up into the space above the closing sleeve 240.

As shown in FIG. 7, the bypass channels 230 can be one or more channels defined in the housing of the assembly 200B bypassing the seats 214, ports 210, and the sliding sleeve 240. For its part, the sleeve 240 can be accessed by tool movement and an appropriate shifter 116 on the inner string 110 to move it relative to the outlet ports 210 between opened and closed positions. (The shifter 116 may be positioned elsewhere on the string 110 other than its position diagrammed in the Figures, and the shifter 116 may be able to open and close the sleeve 240 in opposing directions using features well known in the art.)

Figure 8A:
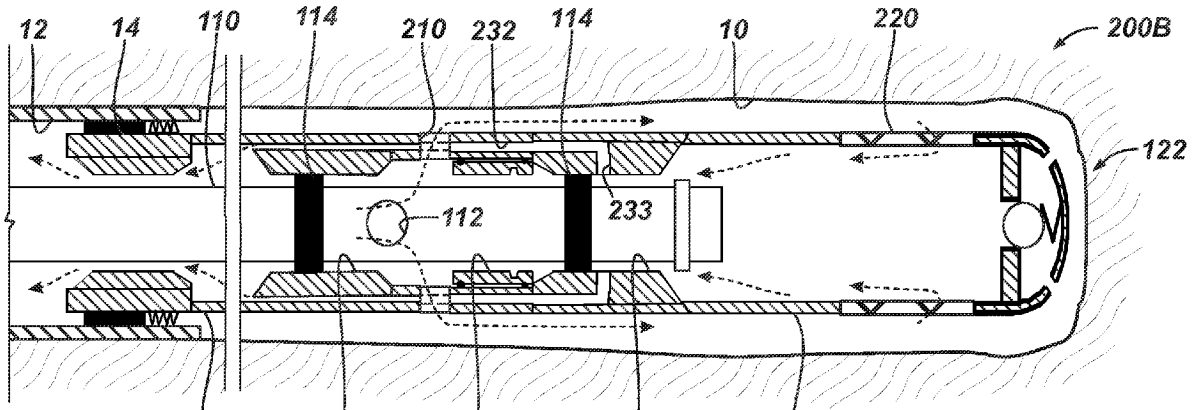
FIGS. 8A-8B show portions of the gravel pack assembly in FIG. 5 having alternative bypass channels.
Figure 8B:
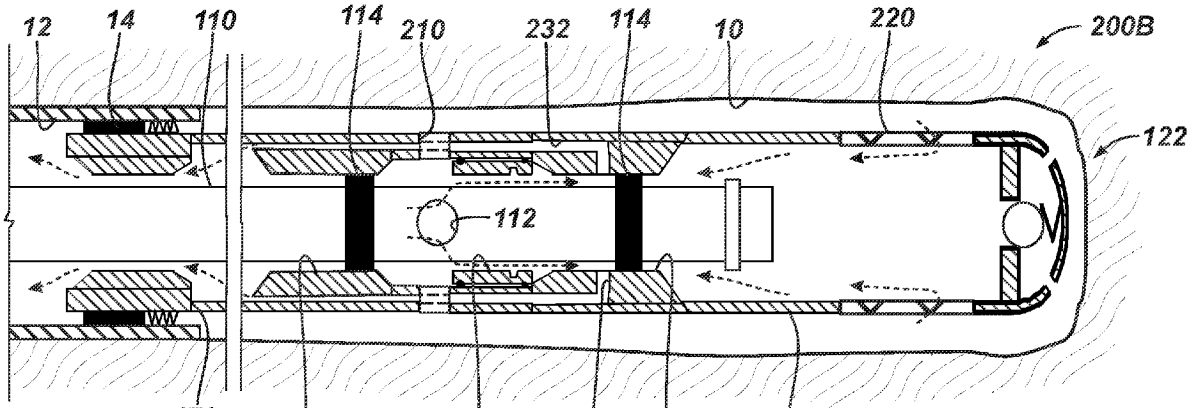

The bypass assembly 200B can uses a number of different types of bypass channels. As shown in FIGS. 8A-8B, for example, channels 232 for the bypass assembly 200B can have a different configuration and can be defined in part of the seats 214. In another alternative shown in FIGS. 9A-9B, channels 234 can use shunt tubes or other conduits disposed externally to the shoe track 120 to allow the fluid returns to flow outside of the ports 210 and the sleeve 240 and then back into the space between the inner string 110 and the shoe track 120. With the benefit of the present disclosure, it will be appreciated that these and other configurations can be used for the bypass channels.

These other configurations can provide a number of additional benefits. For example, the entrances to the channels 232 in FIGS. 8A-8B have gun drilled holes 233 formed transverse to the face of the downhole seat 214. As shown in FIG. 8A, the inner string 110 can be positioned in the bypass assembly 200B with the downhole seal 114 positioned uphole of the gun-drilled holes 233 for the channels 232. In this position, the holes 233 of the channels 232 can receive fluid returns entering the screen 220 during sand disposal so the channels 232 can bypass the outlet ports 210 and seals 114 as before.

Alternatively as shown in FIG. 8B, the inner string 110 can position with the downhole seal 114 downhole of the gun-drilled holes 233, essentially isolating the channels 232 from the lower portion of the shoe track 120. In this position, the holes 233 of the channels 232 can receive fluid exiting the inner string's ports 112 without passing to the shoe track 120. Moreover, reverse flow can communicate fluid from uphole in the assembly 100, to the channels 232, and into the inner string's ports 112. The versatility of this configuration can have a number of advantageous for other procedures, such as cleaning out components, performing chemical injection, and other operations available in the art.

Figure 9A:
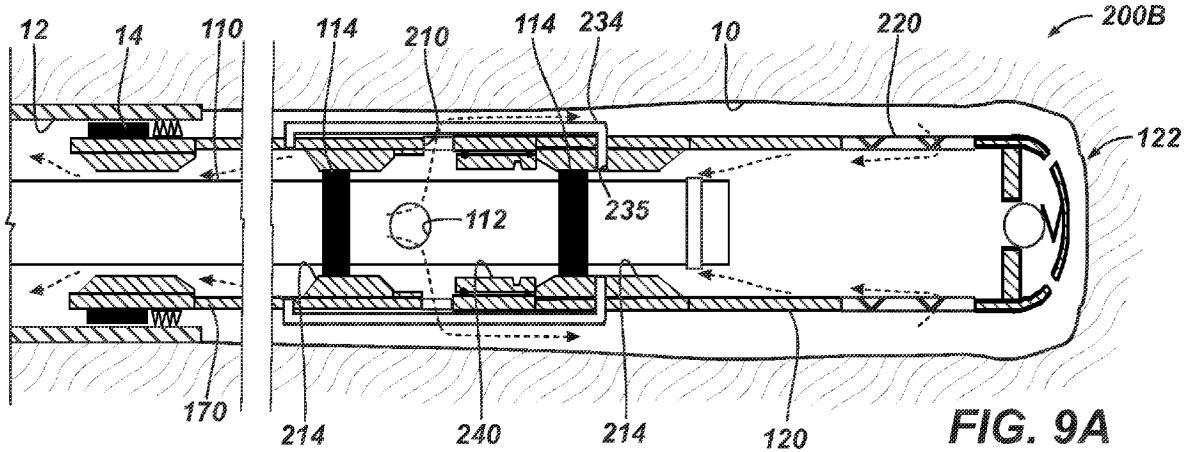
FIGS. 9A-9B show portions of the gravel pack assembly in FIG. 5 having bypass channels in the form of exterior conduits.
Figure 9B:
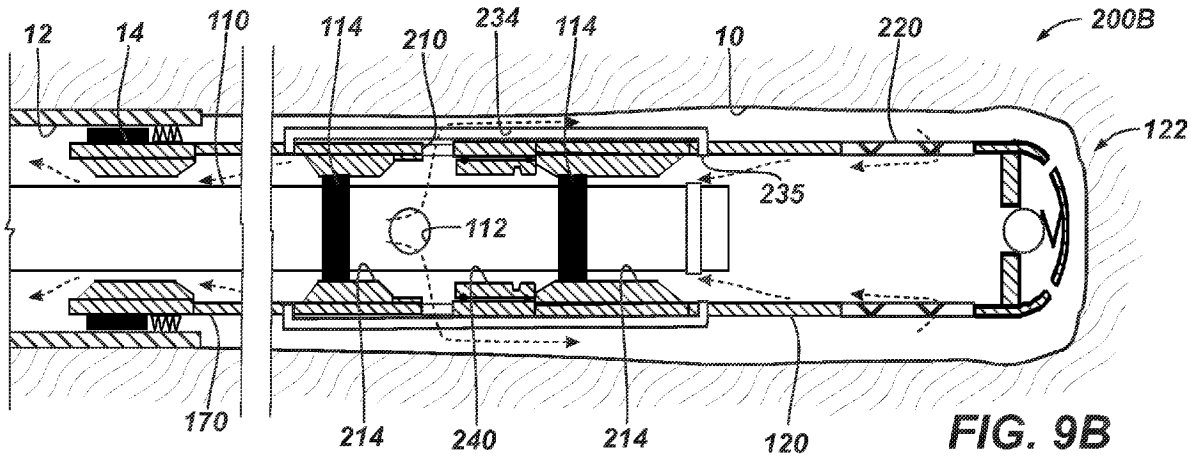

The shunt tube channels 234 of FIG. 9A with their inlets 235 disposed in the downhole seat 214 can offer similar benefits as the channels 232 of FIGS. 8A-8B. Moreover, the shunt tube channels 234 of FIG. 9B show how the inlets 235 can be positioned a distance down the shoe track 120, which may enable the inlets 235 to avoid interference from any components of the inner string 110 disposed in the bypass assembly 200B.

Although the bypass assembly 200B has been shown on the end of the gravel pack assembly 100 at the shoe track 120, it will be appreciated that other parts of the assembly 100 can also include features of such a bypass assembly 200B. For example, a gravel pack section 102 as in FIG. 2 or 5, which lacks a shoe track and float shoe, can include features of the disclosed bypass assembly 200B. In general, the body of such a section 102 may be similar to that shown previously, but would lack a float shoe at its end so that the inner passage could communicate with another downhole gravel pack section 102.

Figures 10A, 10B, 10C:
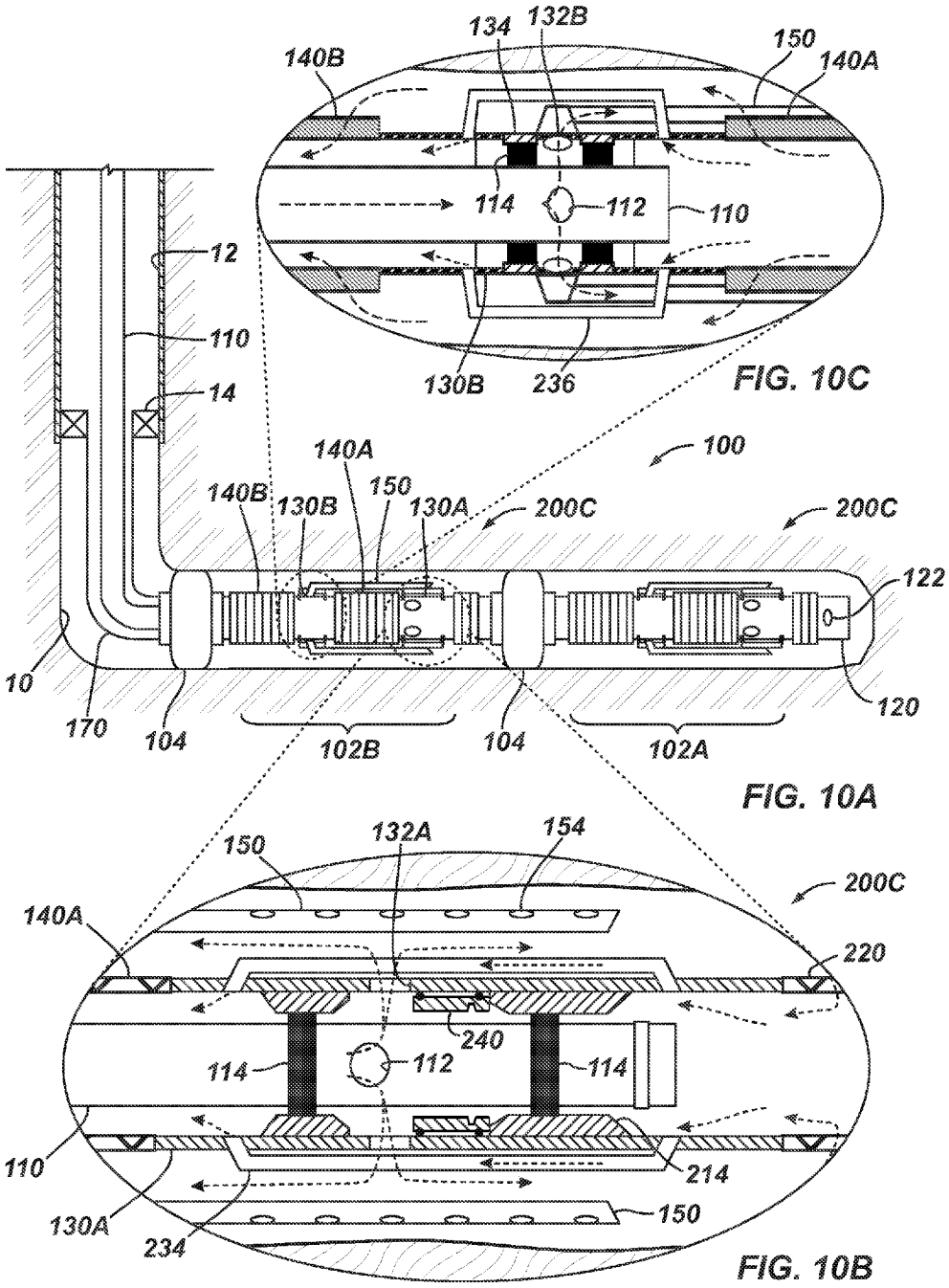

For example, FIGS. 10A-10B show how a bypass assembly 200C can be incorporated into one of the gravel pack sections 102B of an assembly 100. As shown, the assembly 100 has many of the same components discussed previously so they are not addressed again. Yet, the gravel pack sections, such as section 102B shown in detail, includes a bypass assembly 200C according to the present disclosure incorporated into the lower ported housing 130A. The other section 102A has a bypass assembly 200C along with a float shoe.

As shown in FIG. 10A, the section 102B includes the lower ported housing 130A with flow ports 132A, a lower screen section 140A, an upper ported housing 130B with flow ports 132B, shunt tubes 150, and an upper screen section 140B, which are arranged similar to previous arrangements. The lower housing 130A includes a bypass screen 220 and bypass channels (i.e., shunt tube channels 234 in this depiction). The flow ports 132A on the housing 130A have seats 214 and a closure or sliding sleeve 240

During gravel packing operations, the inner string's outlet ports 112 can be isolated with the flow ports 132A while the sliding sleeve 240 is open. Slurry pumped down the inner string 110 can flow out of the ports 112 and 132A to gravel pack the borehole annulus around this section 102B. Slurry will flow uphole to gravel pack around the screen sections 140A-B in a toe-to-heel configuration. Some slurry may flow downhole with fluid returns coming through bypass screen 220 and passing through the bypass channels 234.

When gravel packing is completed at these first flow ports 132A, the inner string 110 can be lifted to the next stage so that the outlet ports 112 communicate with the upper flow ports 132B, which communicate with the shunt tubes 150. As shown in FIGS. 10A-10B, the shunt tubes 150 may terminate in the borehole annulus 150 and may not communicate internally into the assembly near the toe of this gravel pack section 102B as in previous examples.

With string 110 in this position, slurry pumped through the inner string 110 travels into the shunt tubes 150 and into the borehole annulus near the toe of this gravel pack section 102B to pack this toe section or evacuate excess slurry. All the while, fluid returns from this second stage can enter the assembly 100 through the bypass screen 220, flow up the section 102B, and bypass the isolated outlet ports 112 and flow ports 132B. To bypass the isolated ports 112 and 132B, the fluid returns can go out of the screen section 140A and back in through screen section 140B as in previous arrangements (i.e., FIG. 4B). As an alternative shown in FIG. 100, the upper ported housing 130B in this assembly 100 can have a similar arrangement of bypass channels 236 for a more direct path for the fluid returns to bypass the isolated ports 112 and 132B.

Figure 11:
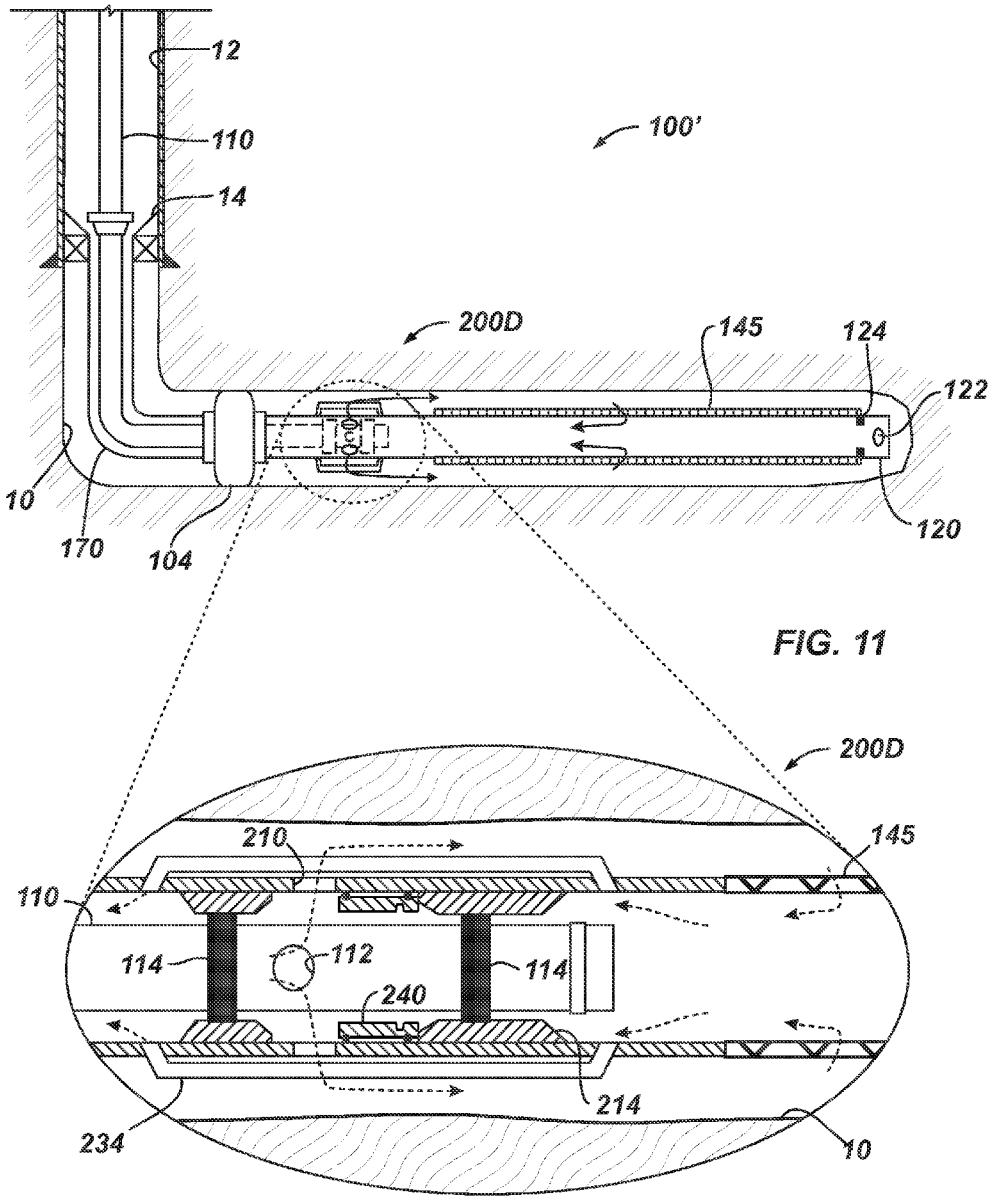
FIG. 11 shows another gravel pack assembly having a bypass assembly according to the present disclosure.

Although the disclosed bypass assemblies (i.e., 200A, 200B, and 200C) have been shown used with a toe-to-heel gravel pack assembly 100, the disclosed bypass assembly can be used with other gravel pack assemblies. For example, FIG. 11 shows another gravel pack assembly 100' having a liner hanger 170 extending from a liner hanger 14 and having a screen 145 separated by a packer 104. A bypass assembly 200D, similar to those disclosed previously, is disposed uphole of the screen 145.

As before, a shoe track 120 at the end of the assembly 100' can have an internal seat 124 so the inner string 110 can seal one of its seals 114 thereon and circulate washdown fluid out the float shoe 122. After washdown, the inner string 110 can be lifted to the bypass assembly 200D uphole of the screen 145 and set up for gravel packing operations.

As shown in the detail of FIG. 11, the closure 240 is opened (with a shifter 116 or the like), and the seals 114 on the inner string 110 seal with the seats 214 inside the assembly 200D. Operators pump slurry down the inner string 110, and the slurry passes out the ports 112 and 210 to gravel pack around the screen 145 in a conventional heel-to-toe configuration. Fluid returns pass through the screen 140 and travel up to the bypass assembly 200D. Inside the assembly 200D, the fluid returns pass into the channels, which are shown here as shunt tube channels 234 although other configurations could be used. Eventually, the fluid returns can pass up the liner 170 and into the casing 12.

When gravel packing is complete, the sliding sleeve 240 can then be closed to prevent fluid communication with the borehole annulus during production. The shunt tube channels 234 can remain as they are because they would simply operate to convey production fluid or the like along the assembly 100'. As evidenced by this assembly 100', the bypass assembly 200D can operate as an external crossover tool disposed on the screen assembly 100' itself. This arrangement can greatly simplify the typical components needed to gravel pack a borehole in a conventional heel-to-toe configuration.

Although only one section of screen 145 and one bypass assembly 200D are shown in FIG. 11, the assembly 100' can have any number of screens 145 and bypass assemblies 200D disposed along its length. Moreover, various packer arrangements can be used between sections of screens 145 and bypass assemblies 200D to compartmentalize separate zones of the borehole 10.

The foregoing description of preferred and other embodiments is not intended to limit or restrict the scope or applicability of the inventive concepts conceived of by the Applicants. It will be appreciated with the benefit of the present disclosure that elements of one embodiment can be combined with or exchanged for components of other embodiments disclosed herein. Reference has been made herein to use of the gravel pack assemblies in boreholes, such as open boreholes. In general, these boreholes can have any orientation, vertical, horizontal, or deviated. For example, a horizontal borehole may refer to any deviated section of a borehole defining an angle of 50-degrees or greater and even over 90-degrees relative to vertical.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gravel pack apparatus for a borehole, comprising:

a body having a body passage communicating from a heel to a toe, the body defining first and second body ports communicating the body passage with the borehole, the second body port defined uphole of the first body port and disposed in fluid communication via the borehole with the first body port;

an inner string movably deploying in the body passage and defining an outlet port, the inner string in a first selective position in the body passage selectively sealing the outlet port with the first body port and communicating gravel pack slurry to the borehole, the inner string moved to a second selective position in the body passage selectively sealing the outlet port with the second body port and communicating the gravel pack slurry from the inner string to the borehole;

a first screen disposed on the body between the first body port and the toe and disposed in fluid communication via the borehole with the first and second body ports, the first screen communicating the body passage with the borehole and passing fluid returns of the gravel pack slurry from the borehole into the body passage; and a bypass being part of the body and communicating the body passage on one side of the first body port to another side of the first body port, the bypass passing the fluid returns in the body passage past the outlet port of the inner string selectively sealed with the first body port.

2. The apparatus of claim 1, wherein the bypass comprises a conduit disposed outside the body, the conduit having an inlet communicating on the one side of the first body port and having an outlet communicating on the other side of the first body port.

3. The apparatus of claim 1, wherein the bypass comprises an internal passage defined in the body, the internal passage having an inlet communicating on the one side of the first body port and having an outlet communicating on the other side of the first body port.

4. The apparatus of claim 1, wherein the bypass at the one side of the first body port comprise a second screen restricting passage of at least some particulate in the fluid returns from entering the bypass.

5. The apparatus of claim 1, wherein the first body port comprises a check valve, a sliding sleeve, a rotating sleeve, a rupture disk, or a screen controlling fluid communication through the first body port.

6. The apparatus of claim 1, wherein the first body port comprises a closure disposed on the body and selectively opening and closing fluid communication through the first body port.

7. The apparatus of claim 6, wherein the closure comprises a sleeve disposed in the body passage and movable therein between opened and closed conditions relative to the first body port.

8. The apparatus of claim 6, wherein the closure selectively opens and closes fluid communication through the bypass.

9. The apparatus of claim 1, wherein the body comprises seats disposed on each side of the first body port, and wherein the inner string comprises seals disposed on each side of the outlet port and sealing with the seats.

10. The apparatus of claim 9, wherein the inner string moved to the first selective position in the body passage seals the seals with the seats and isolates the outlet port in fluid communication with the first body port.

11. The apparatus of claim 10, wherein the bypass comprises an inlet defined in one of the seats, and wherein the inner string moved to a third selective position in the body passage seals the seals with the seats and isolates the outlet port in fluid communication with the first body port and the inlet of the bypass.

12. The apparatus of claim 1, wherein the body defines a third body port downhole of the first screen toward the toe, the third body port disposed in fluid communication via the borehole with the first screen; and wherein the inner string moved to a third selective position in the body passage seals the outlet port in fluid communication with the third body port.

13. The apparatus of claim 12, wherein the third body port comprises a valve permitting fluid flow out the body passage to the borehole and preventing fluid flow from the borehole into the body passage.

14. The apparatus of claim 1, wherein the apparatus comprises a second screen disposed on the body uphole of the second body port and disposed in fluid communication via the borehole with the first screen, the second screen communicating the body passage with the borehole and passing the fluid returns of the gravel pack slurry from the borehole into the body passage.

15. The apparatus of claim 1, wherein the apparatus comprises a second screen disposed on the body between the first and second body ports and disposed in fluid communication via the borehole with the first screen, the second screen communicating the body passage with the borehole and passing the fluid returns of the gravel pack slurry from the borehole into the body passage.

16. The apparatus of claim 1, wherein the body comprises an alternative path device disposed along the body and communicating the second body port with the borehole.

17. The apparatus of claim 1, wherein the body comprises another bypass disposed on the body and communicating the body passage on one side of the second body port to another side of the second body port.

18. The apparatus of claim 1, wherein the body comprises an isolating element disposed uphole of the second body port and isolating portions of the borehole from one another.

19. A gravel packing method for a borehole, the method comprising:

deploying an inner string inside a body disposed in a borehole, the body having a toe and a heel;

isolating fluid communication of an outlet port on the inner string to a first flow port in the body;

pumping gravel pack slurry in the inner string into the borehole by flowing the gravel pack slurry from the outlet port into the borehole through the first flow port;

flowing fluid returns from the borehole into the body through a first screen disposed on the body between the first flow port and the toe;

bypassing the fluid returns uphole of the sealed outlet port and the first flow port by communicating the fluid returns through a bypass being part of the body;

isolating fluid communication of the outlet port to a second flow port in the body, the second flow port defined uphole of the first flow port and disposed in fluid communication via the borehole with the first flow port; and pumping the gravel pack slurry in the inner string into the borehole by flowing the gravel pack slurry from the outlet port into the borehole through the second flow port.

20. The method of claim 19, wherein isolating fluid communication of the outlet to the first flow port comprises sealing seals disposed on each side of the outlet port on the inner string against seats disposed on each side of the first flow port inside the body.

21. The method of claim 19, wherein isolating fluid communication of the outlet port to the first flow port comprises selectively opening a closure on the first flow port.

22. The method of claim 21, wherein bypassing the fluid returns through the bypass comprises selectively opening the bypass with the opening of the closure.

23. The method of claim 19, wherein bypassing the fluid returns comprises flowing the fluid returns through the bypass disposed outside the body.

24. The method of claim 19, wherein bypassing the fluid returns comprises flowing the fluid returns through the bypass disposed inside the body.

25. The method of claim 19, further comprising flowing the fluid returns from the borehole into the body through a second screen disposed on the body at least uphole of the first body port and disposed in fluid communication via the borehole with the first screen.

26. The method of claim 19, wherein flowing the gravel pack slurry from the outlet port into the borehole through the second flow port further comprises communicating the gravel pack slurry from the second flow port to the borehole through an alternative path device disposed along the body.

27. A gravel pack apparatus for a borehole, comprising:

a body having a passage communicating from a heel to a toe, the body defining first and second ports communicating the passage with the borehole, the second port defined uphole of the first port;

an isolating element disposed between the first and second ports and isolating portions of the borehole from one another;

a string movably deploying in the passage and defining an outlet, the string in a first selective position in the passage selectively sealing the outlet with the first port and communicating slurry to the borehole, the string in a second selective position in the passage selectively sealing the outlet with the second port and communicating the slurry from the string to the borehole;

a first screen disposed on the body between the first port and the toe and disposed in fluid communication via the borehole with the first port, the first screen communicating the passage with the borehole and passing fluid returns of the slurry from the borehole into the passage;

a bypass disposed on the body and communicating the passage on one side of the first port to another side of the first port, the bypass passing the fluid returns in the passage past the outlet of the string selectively sealed with the first port; and a second screen disposed on the body uphole of the second port and disposed in fluid communication via the borehole with the second port, the second screen communicating the passage with the borehole and passing the fluid returns of the slurry from the borehole into the passage.

28. The apparatus of claim 27, wherein the body defines a third port downhole of the first screen toward the toe and disposed in fluid communication via the borehole with the first screen; and wherein the string moved to a third selective position in the passage seals the outlet in fluid communication with the third port.

29. The apparatus of claim 28, wherein the third port comprises a valve permitting fluid flow out the passage to the borehole and preventing fluid flow from the borehole into the passage.

30. The apparatus of claim 27, wherein the body defines a third port disposed uphole of the second screen, the third port communicating the passage with the borehole and disposed in fluid communication via the borehole with the second screen; and wherein the string moved to a third selective position in the passage seals the outlet in fluid communication with the third port.

31. The apparatus of claim 27, wherein the body comprises an alternative path device disposed along the body and communicating the third port with the borehole.

32. The apparatus of claim 27, wherein the first port comprises a check valve, a sliding sleeve, a rotating sleeve, a rupture disk, or a screen controlling fluid communication through the first port.

33. The apparatus of claim 27, wherein the first port comprises a closure disposed on the body and selectively opening and closing fluid communication through the first port.

34. The apparatus of claim 33, wherein the closure comprises a sleeve disposed in the passage and movable therein between opened and closed conditions relative to the first port.

35. The apparatus of claim 33, wherein the closure selectively opens and closes fluid communication through the bypass.

36. The apparatus of claim 27, wherein the bypass further comprises means for isolating the outlet in fluid communication with the first port and an inlet of the bypass on the one side of the first port.

37. A gravel pack apparatus for a borehole, comprising:

a body having a passage communicating from a heel to a toe and defining a first port communicating the passage with the borehole;

seats disposed in the passage on each side of the first port;

a string movably deploying in the passage, the string defining an outlet for communicating slurry to the borehole and having seals disposed on each side of the outlet;

a first screen disposed on the body between the first port and the toe, the first screen communicating the passage with the borehole and passing fluid returns of the slurry from the borehole into the passage; and a bypass disposed on the body and having an inlet defined radially in one of the seats, the bypass communicating the passage on one side of the first port to another side of the first port, wherein the string moved to a first selective position in the passage seals the seals with the seats and isolates the outlet in fluid communication with the first port, and wherein the string moved to a second selective position in the passage seals the seals with the seats and isolates the outlet in fluid communication with the first port and the inlet of the bypass.

38. The apparatus of claim 37, wherein the bypass comprises a conduit disposed outside the body, the conduit having the inlet communicating on the one side of the first port and having an outlet communicating on the other side of the first port.

39. The apparatus of claim 37, wherein the bypass comprises an internal passage defined in the body, the internal passage having the inlet communicating on the one side of the first port and having an outlet communicating on the other side of the first port.

40. The apparatus of claim 37, wherein the bypass at the one side of the first port comprise a second screen restricting passage of at least some particulate in the fluid returns from entering the bypass.

41. The apparatus of claim 37, wherein the first port comprises a check valve, a sliding sleeve, a rotating sleeve, a rupture disk, or a screen controlling fluid communication through the first port.

42. The apparatus of claim 37, wherein the first port comprises a closure disposed on the body and selectively opening and closing fluid communication through the first port.

43. The apparatus of claim 42, wherein the closure comprises a sleeve disposed in the passage and movable therein between opened and closed conditions relative to the first port.

44. The apparatus of claim 42, wherein the closure selectively opens and closes fluid communication through the bypass.

45. The apparatus of claim 37, wherein the body defines a third port downhole of the first screen toward the toe and disposed in fluid communication via the borehole with the first screen; and wherein the string moved to a third selective position in the passage seals the outlet port in fluid communication with the third port.

46. The apparatus of claim 45, wherein the third port comprises a valve permitting fluid flow out the passage to the borehole and preventing fluid flow from the borehole into the passage.

* * * * *